US006217389B1

(12) United States Patent
Jatou

(10) Patent No.: US 6,217,389 B1
(45) Date of Patent: Apr. 17, 2001

(54) UNIVERSAL SERIAL BUS CONNECTOR WITH AN INTEGRAL OVER-CURRENT PROTECTION DEVICE AND INDICATOR

(75) Inventor: Ross Jatou, Scarborough (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/245,885

(22) Filed: Feb. 8, 1999

(51) Int. Cl.[7] ..... H01R 13/68; H01R 33/95

(52) U.S. Cl. ..... 439/622

(58) Field of Search ..... 439/622, 490, 439/607, 608, 609, 610, 95, 108, 620

(56) References Cited

U.S. PATENT DOCUMENTS

| | | | | |
|---|---|---|---|---|
| 4,484,185 | * | 11/1984 | Graves | 439/622 |
| 4,500,159 | | 2/1985 | Briones et al. . | |
| 4,695,115 | | 9/1987 | Talend . | |
| 4,799,901 | | 1/1989 | Pirc . | |
| 4,924,345 | | 5/1990 | Siemon et al. . | |
| 4,978,317 | | 12/1990 | Pocrass . | |
| 5,030,140 | | 7/1991 | Sugiyama . | |
| 5,057,041 | | 10/1991 | Yu et al. . | |
| 5,073,123 | | 12/1991 | Birch et al. . | |
| 5,102,354 | | 4/1992 | Crane et al. . | |
| 5,108,300 | | 4/1992 | Weber . | |
| 5,125,054 | | 6/1992 | Ackley et al. . | |
| 5,188,543 | | 2/1993 | Swift . | |
| 5,246,388 | | 9/1993 | Collins et al. . | |
| 5,320,560 | | 6/1994 | Fladung . | |
| 5,326,280 | | 7/1994 | Briones et al. . | |
| 5,344,342 | | 9/1994 | Briones . | |
| 5,360,353 | | 11/1994 | Kinoshita . | |
| 5,397,250 | | 3/1995 | Briones . | |
| 5,403,207 | | 4/1995 | Briones . | |
| 5,741,152 | | 4/1998 | Boutros . | |
| 5,797,770 | * | 8/1998 | Davis et al. | 439/607 |

FOREIGN PATENT DOCUMENTS

| | | |
|---|---|---|
| 3005652 | 6/1981 | (DE) . |
| 3637191 | 9/1987 | (DE) . |
| 2070868 | 9/1981 | (GB) . |

* cited by examiner

*Primary Examiner*—Paula Bradley
*Assistant Examiner*—Antoine Ngandjui
(74) *Attorney, Agent, or Firm*—Blank Rome Comisky & McCauley, LLP

(57) ABSTRACT

A Universal Serial Bus connector is arranged to include in-line over-current protection components by dividing horizontal sections of the Universal Serial Bus connector power lines or contacts into vertically offset front and rear contact sections having a predetermined distance therebetween to provide a space into which the over-current protection components can be positioned, the space being narrower than the height of the protection device so that a good electrical connection is established when the protection device is inserted between the contact sections. The connector may also include at least one LED connected to one of the front contact sections between the protection device and a mating end of the front contact section to provide an immediate visual indication of whether an over-current has occurred.

9 Claims, 2 Drawing Sheets

UNIVERSAL SERIAL BUS CONNECTOR WITH AN INTEGRAL OVER-CURRENT PROTECTION DEVICE AND INDICATOR

BACKGROUND OF THE INVENTION

1. Field of the Invention

This invention relates to the field of electrical connectors, and in particular to a Universal Serial Bus (USB) connector with a built-in or integral over-current protection device such as a fuse. The invention also relates to a Universal Serial Bus connector with a built-in or integral over-current indicator.

2. Description of Related Art

The Universal Serial Bus connector is a recently developed connector that is designed to replace all the various input/output interfaces currently used on personal computers, providing a single interface for all peripherals. The Universal Serial Bus specifications support hot pluggability, permitting peripherals to be connected and disconnected to a computer system without having to shut down the system, and includes such features as polarization and power contact positions. In addition, the specifications call for the inclusion of a resettable fuse on the interface card to protect the system from over-currents.

Placement of a fuse on the interface card fulfills the need for system protection, but makes the fuse difficult to access, and thus when an over-current condition does occur and the connection is broken, it is difficult for a user to diagnose the reason why data is not being transferred, causing the user to waste time checking aspects of the system that are not at fault.

The present invention seeks to provide a Universal Serial Bus interface in which the over-current protection device is integrated in a practical manner into the bus connector rather than provided on the interface card. In addition to the usual advantages of integrating components, i.e., space savings on the circuit board and convenience, integration of the over-current protection device into the connector has the advantage of enabling the source of a data or power transmission failure to be more readily traced because the device can then be connected to an indicator light placed at the front of the connector where it is visible to a user without having to open the computer system and examine the card itself.

It has previously been proposed to place an over-current protection device such as a resettable fuse in a Universal Serial Bus connector by including a printed circuit board within the connector, and soldering the over-current protection device to the printed circuit board. However, inclusion of a printed circuit board in the small space available in the Universal Serial Bus connector and other similar high speed data connectors is inconvenient and significantly increases the difficulty and costs of assembling the connector.

It has also previously been proposed to include indicator lights within the housing of electrical connectors. However, none of the prior electrical connector indicator lights is arranged to provide an indication of the condition of a component within the connector itself. Instead, the indicator lights of the prior connectors are arranged to have leads extending to the circuit board for indicating the presence or absence of a signal in the signal lines. In contrast, an over-current condition that causes a fuse to open can only be detected by shunt connecting the indicator to the protection device so that the presence of a current on the input line to the connector will cause the indicator light to illuminate when the fuse is in an open circuit condition.

Because of the difficulties in placing an in-line component in a data bus connector, and despite the potential for space savings on the circuit board and more convenient assembly, there has been little motivation to attempt such placement. However, if there were a way to fit an in-line component into a data bus connector, such as the Universal Serial Bus connector, in a relatively simple manner, then the advantages of space savings and convenience would begin to outweigh the difficulties. Add the possibility of providing an indication of line problems and the resulting connector would represent a significant improvement over existing Universal Serial Bus connectors.

SUMMARY OF THE INVENTION

It is accordingly an objective of the invention to provide a data bus connector, such as the Universal Serial Bus connector, having an integral over-current protection device which is simple in structure and easily assembled to the connector. it is a further objective of the invention to provide a data bus connector that affords a visual indication of current faults in the system.

It is a still further objective of the invention to provide a structure for integrating an over-current protection device into a data bus connector without requiring soldering.

These objectives are achieved, in accordance with the principles of a preferred embodiment of the invention, by providing a Universal Serial Bus connector having in-line over-current protection components in which horizontal sections of the Universal Serial Bus connector power lines or contacts are divided into vertically offset front and rear contact sections to provide a space into which the over-current protection components can be positioned, the space being narrower than the height of the protection device so that a good electrical connection is established when the protection device is inserted between the contact sections, thereby eliminating the need for soldering of the protection device to the contacts.

In an especially preferred embodiment of the invention, the connector includes an LED for each of the over-current protection components, the LEDs being connected to indicate whether an over-current has occurred, for example by shunt connecting the LED between the power input side of the connector and a grounded shield of the connector. The LEDs may be mounted in a manner similar to the mounting arrangements described in U.S. Pat. Nos. 4,978,317 and 5,017,156, herein incorporated by reference, with one LED being provided for each protection device in the connector.

DETAILED DESCRIPTION OF THE PREFERRED EMBODIMENTS

Figures 1A, 1B, 2, 3, 4:
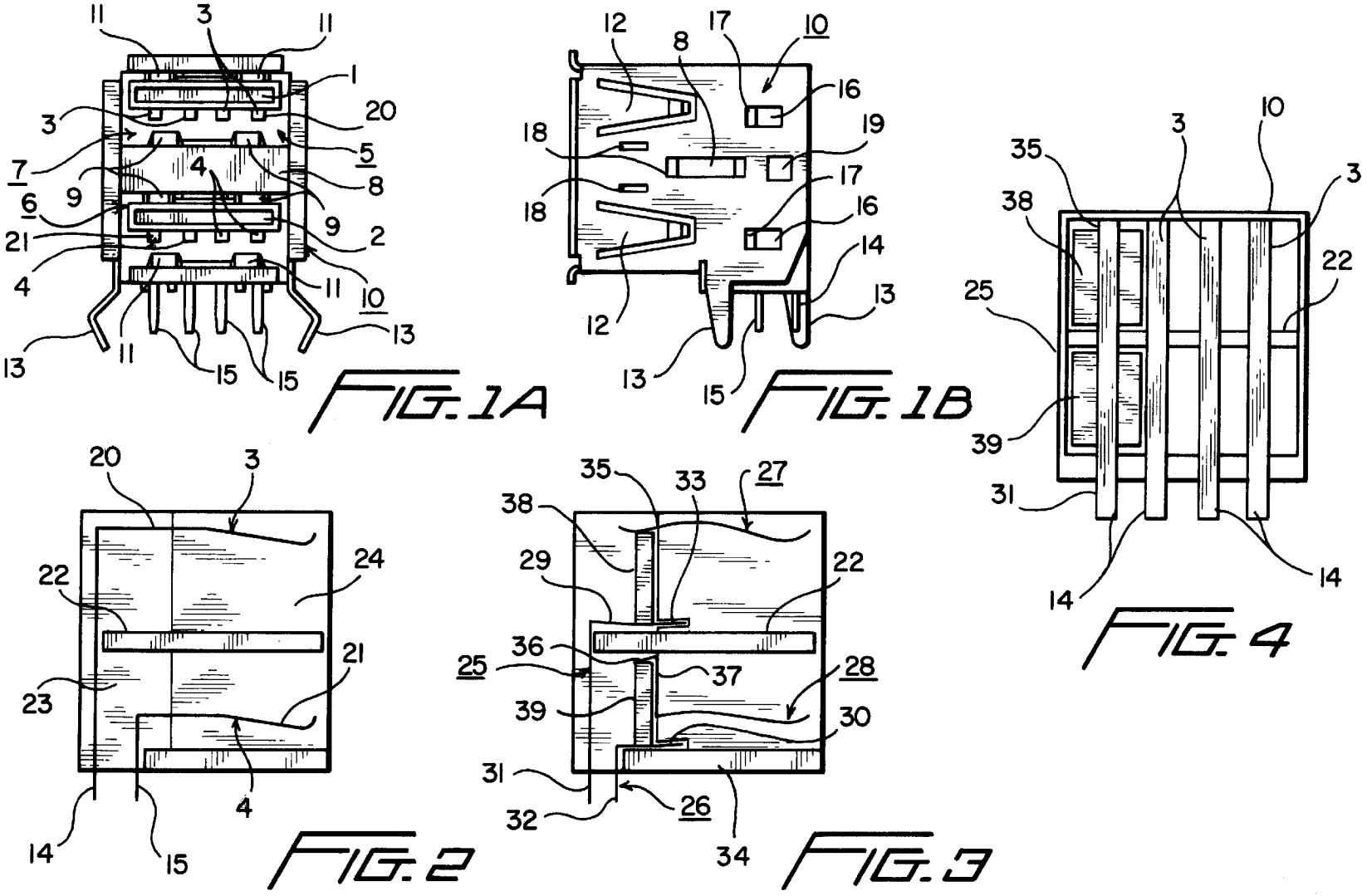
FIG. 1A is a front view of a Universal Serial Bus connector to which the principles of a preferred embodiment of the invention may be applied.
FIG. 1B is a side view of the Universal Serial Bus connector of FIG. 1A.
FIG. 2 is a schematic cross-sectional side view showing the elements of the conventional Universal Serial Bus connector to which the principles of the invention are applied.
FIG. 3 is a cross-sectional side view of a Universal Serial Bus connector with integral over-current protection components constructed in accordance with the principles of the invention.
FIG. 4 is a rear view of the connector of FIG. 3.

As illustrated in FIGS. 1A and 1B, a Universal Serial Bus socket connector includes a pair of dielectric contact supports 1 and 2 for supporting respective rows of four upper contacts 3 and four lower contacts 4. Each of the two rows of contacts is arranged to mate with a corresponding Universal Serial Bus plug connector received in one of the openings 5 and 6 surrounding the contacts. Supports 1 and 2 are generally arranged to extend from a single dielectric main body or housing 7 which also includes a portion that extends forwardly into the space between the contacts to define the two openings, and which supports an internal shielding member 8 from which extend ground tabs 9 for engaging corresponding outer shields of the two connector mating plugs. The external shield 10 of the socket connector also includes inwardly extending upper and lower ground tabs 11 and side tabs 12. Grounding to the circuit board is provided by board locks 13, one of the rear board locks having been removed in FIG. 1B to show the location of the circuit board tails 14 of upper contacts 3, only the circuit board tails 15 of lower contacts 4 being visible in FIG. 1A. Extensions 16 of the main housing 7 engage openings 17 at the rear of the shield 10 to secure the shield to the main housing, and openings 18 securing the internal shield 8. The rear panel of the shield (not shown), which may be integral or separate from the main portion of the shield 10, is secured or held in place by shield openings 19.

The Universal Serial Bus socket contact illustrated in FIGS. 1A and 1B is available from a number of sources, including Amphenol Data/Telecom Products, 20 Melford Drive, Scarborough, Ontario, Canada M1B 2X6. Internal details of the connector, including the configuration of the contact supports and manner of contact mounting, may be varied without affecting the overall compatibility and performance of the connector. In addition, while a socket connector capable of receiving two standard Universal Serial Bus plugs is illustrated, socket connectors having the same general configuration but which are arranged to receive a single plug, and therefore do not require internal shielding, are also available, as is an alternative configuration in which two contacts are positioned on the top surface of the contact support and two are positioned on the lower surface of the contact support, a configuration in which the contacts and board locks extend horizontally form the rear of the connector for vertical mounting of the connector, and a configuration in which the tails of the contacts are arranged for surface mounting rather than for insertion into holes into the circuit board or card on which the contacts were mounted. Those skilled in the art will appreciate that the present invention is applicable to all such versions of the Universal Serial Bus socket connector, as well as to similar data bus connectors.

The general configuration of the contacts in the connector of FIGS. 1A and 1B is illustrated in FIG. 2. Each of the upper and lower contacts 3 and 4 includes, in addition to the circuit board tails 14 and 15, horizontal portions 20 and 21 supported by the respective contact supports 1 and 2. A support 22 for the internal shield 8 is schematically illustrated in FIG. 2 as extending from supports 1 and 2 into a space 23 at the rear of the connector, the dielectric member that includes upper and lower supports 1 and 2 being schematically illustrated as a single block 24.

In contrast, in accordance with the principles of a preferred embodiment of the invention on each of the upper and lower contacts 3 and 4 are respectively divided into rear contact sections 25,26 and front contact sections 27,28. Respective upper and lower rear contact sections 25,26 are, in the illustrated embodiment, each in the form of inverted L-shaped members including horizontal portions 29,30 and tails 31,32 extending from a lower surface of the connector, although those skilled in the art will appreciate that the tails 29,30 could also extend linearly from the rear of the connector to form a vertical header, or be in the form of surface mount contact tails. The horizontal portions 29,30 of the rear contact sections 25,26 may be fitted into slots 33,34 provided at the rear of the dielectric housing member 7, or supported by any other suitable arrangement. Front contact sections 27,28 are generally horizontal in configuration and resemble the mating portions of the standard contacts 3,4 shown in Fig 2, but the rear portions 35,36 of one or both of the front contact sections 27,28 may include a vertical portion 37 as necessary to provide a predetermined vertical distance between the front horizontal portions 29,30 of the rear contact sections 25,26 and the rear horizontal portions 35,36 of the front contact sections 27,28. In the illustrated configuration, one vertical portion is required, for the lower front contact section 28.

Positioned in the vertical space between the respective front portions 29,30 and rear portions 35,36 of the rear and front contact sections 25–28 are over-current protection devices 38,39. The protection devices 38,39 are in the form of resettable fuses or other over-current protection devices having electrodes at their top and bottom, with the distance between the respective front and rear horizontal portions 29,30 and 35,36 of the rear and front contact sections 25–28 preferably being slightly less than the height of the protection devices 38,39 so that the contacts are pushed apart when the protection devices are inserted therebetween, the resilience of the contacts serving to position and hold the protection devices, and to ensure a good electrical connection without the need for soldering. In addition, those skilled in the art will appreciate that the insulating housing 7 may be molded to include features for retaining the protection devices, such as resilient arms or detents that permit the protection devices to be snapped into the connector housing.

Those skilled in the art will also appreciate that although the protection device mounting structure of the invention, as indicated above, has been illustrated in the context of a dual plug Universal Serial Bus connector, the principles of the invention apply equally to single plug Universal Serial Bus connectors having only a single contact support structure and a single row of contacts, or a pair of contacts on each side of the single contact support structure. In addition, the principles of the invention may be used to install, in a Universal Serial Bus connector, electrical devices other than or in addition to the illustrated resettable fuses. As is apparent from FIG. 4, the resettable fuses are installed on only one of the contacts, and in particular on one of the power contacts, but it is within the scope of the invention to install fuses or other over-current protection devices on any, some, or all of the contacts.

Figure 5:
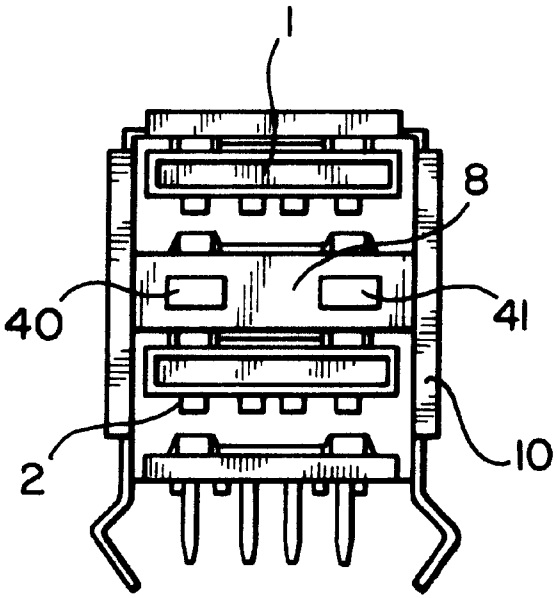
FIG. 5 is a front view of a Universal Serial Bus connector including an indicator light arranged to indicate whether an over-current condition has occurred.

The embodiment of FIG. 5 is identical to the embodiment of FIGS. 2–4, except that the connector is further arranged to include indicator lights 40,41 for indicating whether an over-current condition has occurred. The indicator lights are most conveniently in the form of light emitting diodes (LEDs), but other types of lighting elements may also be used. The indicator lights 40,41 are mounted in passages in the support for the internal shield 8, which includes openings through which the indicator lights can be viewed. Examples of suitable indicator lights and mounting arrangements for the indicator lights are described in U.S. Pat. Nos. 4,978,317 and 5,017,156, incorporated herein by reference, although the connections for the leads of indicator lights 40,41 are different than those disclosed in the prior patents.

Figure 6:
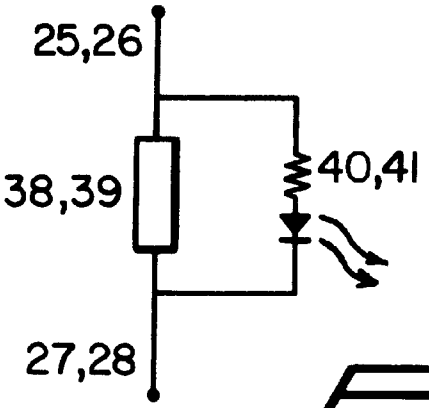
FIG. 6 is a schematic circuit diagrams illustrating the manner in which the indicator lights of FIG. 5 may be connected to illuminate when an over-current condition occurs.

In particular, in order to enable the lighting elements 40,41 to indicate an over-current condition, each indicator light is preferably connected in the manner schematically illustrated in FIG. 6, by connecting the indicator lights in parallel with corresponding circuit protection devices 38,39, and by connecting the leads of the indicator lights to the respective front and rear contact sections 25,26 and 27,28.

Having thus described a preferred embodiment of the invention with sufficient particularity to enable those skilled in the art to easily make and use the invention, and having described several possible variations and modifications of the preferred embodiment, it should nevertheless be appreciated that still further variations and modifications of the invention are possible, and that all such variations and modifications should be considered to be within the scope of the invention. Accordingly, the scope of the invention should not be limited by the above description, but rather should be interpreted solely in accordance with the appended claims.

I claim:

1. A Universal Serial Bus Connector, comprising:

a plurality of electrical contacts, each having a first end configured to mate with a corresponding contact of a Universal Serial Bus connector plug, and a second end configured to be terminated to a circuit board on which the connector is positioned, wherein at least one of the electrical contacts is divided into a front section including said first end and a rear section including said second end, wherein a rear end of said front section opposite the first end which is configured to mate with a corresponding contact of a Universal Serial Bus Connector plug is spaced apart from a front end of said rear section opposite the second end which is configured to be terminated to a circuit board, and wherein an electrical device is positioned in the space between said rear end of the front section and the front end of the rear section, and by engagement between leads of the electrical device and the respective front section rear end and rear section front end, electrically connected between said front and rear contact sections.

2. A connector as claimed in claim 1, wherein the electrical device is an over-current protection device.

3. A connector as claimed in claim 1, wherein the over-current protection device is a resettable fuse.

4. A connector as claimed in claim 1, wherein said front section includes a horizontal forward mating portion, a horizontal rear portion including said rear end, and a vertical intermediate portion that determines a distance between said rear end of the front section and the front end of the rear section.

5. A connector as claimed in claim 1, wherein a distance between said rear end of the front section and the front end of the rear section is less than a height of said electrical device when the connector is fully assembled without inclusion of the electrical device.

6. A connector as claimed in claim 1, further comprising an indicator light mounted in the connector and arranged to illuminate when an over-current condition occurs.

7. A connector as claimed in claim 6, wherein said indicator light is connected between ends of said electrical device.

8. A connector as claimed in claim 6, wherein said electrical device is an over-current protection device.

9. A connector as claimed in claim 8, wherein said electrical device is a resettable fuse.

* * * * *